US006250382B1

(12) United States Patent
Rayburn et al.

(10) Patent No.: US 6,250,382 B1
(45) Date of Patent: Jun. 26, 2001

(54) METHOD AND SYSTEM FOR CONTROLLING A HEATING, VENTILATING, AND AIR CONDITIONING UNIT

(75) Inventors: Ronald R. Rayburn; Neil A. Hughes, both of Norman, OK (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 09/304,640

(22) Filed: May 4, 1999

(51) Int. Cl.[7] ..... F24F 11/04

(52) U.S. Cl. ..... 165/248; 165/251; 454/256

(58) Field of Search ..... 165/209, 217, 165/248, 249, 250, 251; 236/49.3; 454/256

(56) References Cited

U.S. PATENT DOCUMENTS

| | | | | |
|---|---|---|---|---|
| 2,407,036 | | 9/1946 | Snavely . | |
| 3,788,386 | | 1/1974 | Demaray . | |
| 3,887,127 | | 6/1975 | Jauss . | |
| 3,949,807 | | 4/1976 | Tyler . | |
| 3,979,922 | * | 9/1976 | Shavit | 165/251 X |
| 3,982,583 | * | 9/1976 | Shavit | 165/249 |
| 4,018,266 | * | 4/1977 | Kay | 165/249 X |
| 4,086,781 | | 5/1978 | Brody et al. . | |
| 4,109,704 | * | 8/1978 | Spethmann | 165/249 |
| 4,118,209 | * | 10/1978 | Exler et al. | 165/249 X |
| 4,186,564 | | 2/1980 | Myers . | |
| 4,271,898 | | 6/1981 | Freeman . | |
| 4,293,027 | | 10/1981 | Tepe et al. . | |
| 4,347,712 | | 9/1982 | Benton et al. . | |
| 4,353,409 | | 10/1982 | Sauners et al. . | |
| 4,379,484 | | 4/1983 | Lom et al. . | |
| 4,389,853 | | 6/1983 | Hile . | |
| 4,404,815 | | 9/1983 | Gilson . | |
| 4,462,539 | | 7/1984 | Gilson . | |
| 4,478,056 | | 10/1984 | Michaels, Jr. . | |
| 4,530,395 | | 7/1985 | Parker et al. . | |
| 4,531,573 | | 7/1985 | Clark et al. . | |
| 4,711,394 | | 12/1987 | Samuel . | |
| 4,843,084 | | 6/1989 | Parker et al. . | |
| 4,886,110 | | 12/1989 | Jackson . | |
| 5,076,346 | | 12/1991 | Otsuka . | |
| 5,092,394 | | 3/1992 | Foster . | |
| 5,520,328 | | 5/1996 | Bujak, Jr. | 236/49.3 X |
| 5,769,314 | | 6/1998 | Drees et al. | 236/49.3 |
| 5,772,501 | | 6/1998 | Merry et al. | 454/256 |

* cited by examiner

*Primary Examiner*—Ira S. Lazarus
*Assistant Examiner*—Ljiljana V. Ciric
(74) *Attorney, Agent, or Firm*—Finnegan, Henderson, Farabow, Garrett & Dunner, L.L.P.

(57) ABSTRACT

A method and system for controlling a heating, ventilating, and air conditioning unit is provided. The system includes a conditioning unit having a heating stage, a cooling stage, and a fan. The conditioning unit operates in an active mode where one of the heating stage and the cooling stage is activated to condition air in an enclosure. The conditioning unit also operates in a ventilation mode to provide supply air to the enclosure. A supply temperature sensor is provided to sense the temperature of the supply air. A central control operates to activate one of the heating stage and the cooling stage when the conditioning unit is operating in the ventilation mode and the temperature of the supply air is outside of a predetermined range.

29 Claims, 8 Drawing Sheets

METHOD AND SYSTEM FOR CONTROLLING A HEATING, VENTILATING, AND AIR CONDITIONING UNIT

BACKGROUND OF THE INVENTION

The present invention relates generally to a heating, ventilating, and air conditioning system. More particularly, the present invention relates to a method and system for controlling a heating, ventilating, and air conditioning system.

Heating, ventilating, and air conditioning (HVAC) systems are used in both warm and cold climates to control the temperature of the air in a building or zone or zones within a building. An HVAC system typically includes a fan, a heating unit, and a cooling unit. The HVAC system may be operated in one of three modes: a heating mode to heat the enclosure, a cooling mode to cool the enclosure, or a ventilation mode to ventilate the enclosure.

Typically, a supply duct and a return duct connect the HVAC system to the zone or zones being conditioned. The fan operates to push air through the supply air duct and into the zone(s). Air is circulated through the zone(s) and back to the HVAC system through the return duct. The HVAC system may also include an outdoor air damper, commonly referred to as an economizer, that can be selectively opened to varying degrees, to allow outside air to mix with the return air to provide fresh air to the zone(s).

The operation of a HVAC system is governed by a control system, typically including a thermostat and associated programmable control hardware and software that sense parameters and control the various components of the particular HVAC system. The control system allows a user to select the operating mode of the HVAC system. In addition, the user may select a desired temperature for the zone or zones. The control activates the heating and cooling units in the HVAC system to maintain the desired temperature in the zone(s).

If the HVAC system is set to operate in the cooling mode and the temperature of the area exceeds the desired temperature, the HVAC system will activate the fan and the cooling stage. The fan blows air through the cooling unit and into the zone(s), thereby reducing the temperature of the air in the zone(s). Once the zone(s) are cooled to below the set temperature, the control device will turn off the cooling unit, or lower the stage of the cooling system, if it is a multi-stage system. Similarly, if the HVAC system is set to operate in the heating mode and the temperature of the zone(s) drops below the set temperature, the control device will activate the heating unit to warm the zone(s). The fan blows air through the heating unit and into the zone(s), thereby warming the zone(s). When the temperature rises above the desired temperatures the control device will shut off the heating unit, or lower the stage or capacity of the heating system, if it is a variable capacity or multi-stage system.

In certain HVAC systems, such as a constant volume HVAC system servicing a plurality of zones at a relatively constant volume of air flow, the unit will switch to the ventilation mode after the heating or cooling needs of the enclosure are satisfied. In the ventilation mode, the economizer is opened to allow outdoor air to enter the HVAC system. The fan mixes the outdoor air with the return air to ventilate the zone(s). The amount of air that is allowed through the economizer is governed by local building codes. According to these codes, the damper must typically be open at least 15% to 35%.

If there is a large temperature difference between the outdoor air and the air in the enclosure, the ventilation mode may cause discomfort within the zone or room. If, for example, the HVAC system is located in a hot climate where the outdoor temperature is much greater than the temperature of the zone(s), the mixture of the hot outdoor air with the air in the return duct results in supply air that is much warmer than the air in the zone. When this warm supply air enters the relatively cool enclosure, the flow of this warm air will be uncomfortable to persons near the supply vents and may cause hot spots in the room or zone. In addition, adding this warm supply air to the zone(s) will cause the temperature of the enclosure to rise rapidly. Similarly, if the outside air is very cold relative to the indoor temperature, the air supplied in the ventilation mode will be too cold and will cause similar problems in the opposite extreme.

In light of the foregoing there is a need for a method and system for controlling a heating, ventilating, and air conditioning system to control the temperature of the supply air in the ventilating mode.

SUMMARY OF THE INVENTION

Accordingly, the present invention is directed to a method and system for controlling a heating, ventilating, and air conditioning unit and maintaining the temperature of the conditioned air within a comfortable range. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a system for conditioning air to be applied to one or more zones, so that the conditioned air applied to the zone(s) is maintained within a comfortable range. The system includes a conditioning unit that has a heating stage, a cooling stage, a fan, and an air damper, typically an economizer. The conditioning unit operates in an active mode where one of the heating stage and cooling stage is activated to condition air and in a ventilation mode where the fan moves supply air into the enclosure. Typically, the economizer is at least partially open during the operation of any of these modes. A supply air duct is provided for conducting the supply air from the conditioning unit to the zone or zones to be conditioned. A supply temperature sensor senses the temperature of the supply air. There is further provided a central control that activates one of the heating stage and cooling stage when the conditioning unit is in the ventilation mode and the temperature of the supply air is outside of a predetermined temperature range.

In another aspect, the invention is directed to a central control for an air conditioning system having a cooling stage, a fan, an air damper, and a temperature sensor. The air conditioning system operates in an active mode where the cooling stage is activated and in a ventilation mode where the fan is operated to provide supply air to zone(s). The temperature sensor senses the temperature of the supply air. The central control includes a thermostat to set an upper temperature setpoint and a lower temperature setpoint and associated hardware and instructions (such as software) to control the components of the system. The central control activates the cooling stage when the air conditioning system is operating in the ventilation mode and the temperature of the supply air is greater than the upper temperature setpoint.

In yet another aspect, the invention is directed to a central control for a heating system having a heating stage, a fan, an air damper, and a temperature sensor. The heating system operates in an active mode where the heating stage is activated and in a ventilation mode where the fan is operated to provide supply air to zone(s). The temperature sensor senses the temperature of the supply air. The central control includes a thermostat to set an upper temperature setpoint and a lower temperature setpoint and associated hardware and instructions (such as software) to control the components of the system. The central control activates the heating stage when the heating system is operating in the ventilation mode and the temperature of the supply air is less than the lower temperature setpoint.

In still another aspect, the invention is directed to a method of conditioning the air in one or more zones. The method involves operating a heating, ventilating, and air conditioning unit in a ventilation mode to provide supply air to the zone(s). The temperature of the supply air is sensed. When the system is in the ventilation mode, one of a heating stage and a cooling stage in said conditioning unit is activated to condition the supply air when the sensed temperature of the supply air is outside of a predetermined range.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to embodiments of the invention, examples of which are illustrated in the accompanying drawings. Wherever possible, the same reference numbers will be used throughout the drawings to refer to the same or like parts.

In accordance with the present invention, a system for conditioning the air in one or more zone(s) is provided. The present invention contemplates that the zone(s) may be a single room or a number of interconnected rooms or any other enclosure or enclosures being conditioned. In the preferred embodiment, the invention contemplates that the zone(s) are conditioned by a roof top HVAC unit, preferably having a number of cooling or heating stages. An exemplary embodiment consistent with the present invention is illustrated in FIG. 1 and is generally designated by the reference number 20.

Figure 1:
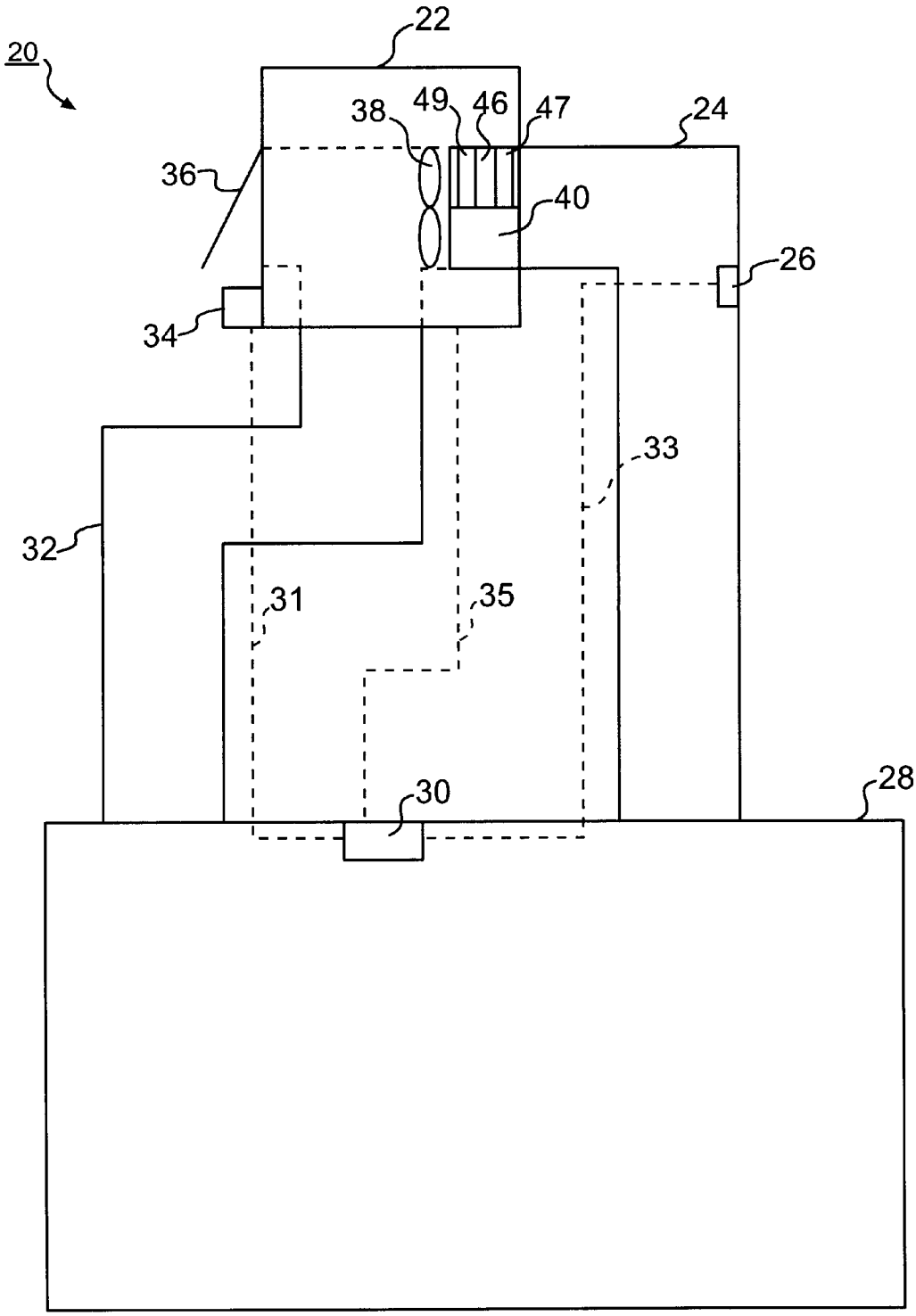
FIG. 1 is a schematic diagram of an air conditioning system according to the present invention.

As illustrated in FIG. 1, system 20 includes a conditioning unit 22 for conditioning the air in an enclosure 28. In the illustrated embodiment, conditioning unit 22 is a heating, ventilating, and air conditioning (HVAC) unit. The present invention can be applied to a variety of conditioning units 22, including, but not limited to, conventional heating systems and air conditioning systems, such as multi-stage cooling units including a plurality of staged compressors and multi-staged or variable heating units utilizing steam, hot water, heat pumps, or electrical resistance heaters. Preferably, conditioning unit 22 is a constant volume roof top HVAC unit and is physically located on top of or adjacent to the enclosure to be conditioned. The invention can be applied to units that only cool the air, as well as to units that only heat the air.

The conditioning unit 22 is connected to enclosure 28 by a supply air duct 24. Supply air duct 24 includes a temperature sensor 26 for sensing the temperature of the air in the supply air duct. A number of different conventional temperature sensors can be used and positioned at a variety of locations within the supply duct 24, as long as the sensed temperature is representative of the air supplied to the zone(s). A return air duct 32 connects zone 28 to conditioning unit 22 and return air from the zone back to the conditioning unit as is known in the art.

For purposes of ease of understanding, the system shown schematically in FIG. 1 includes only a single enclosure. However, the invention can be applied to multi-zone systems, each zone being connected to the supply duct by separate ducting, and also to the return duct by separate ducting. Preferably, the system is a multi-zone constant air volume system where the individual ducts are open. The invention also can be applied to variable volume systems, where the individual ducts to individual zones include an adjustable damper, controlled to selectively open and close by the central control.

Conditioning unit 22 includes a fan 38, which may be a blower or any other device for moving air that is readily apparent to one skilled in the art. Operation of fan 38 moves air through conditioning unit 22 and into supply air duct 24. Supply air duct 24 guides the air from conditioning unit 22 to zone(s) 28. Air is circulated back to conditioning unit 22 through return air duct 32. For purposes of this disclosure, the air entering the enclosure from the supply air duct will be referred to as "supply air" and the air returning to the conditioning unit from the enclosure will be referred to as "return air."

As shown in FIG. 1, conditioning unit 22 also includes an air damper 36. Air damper 36 may be modulated to allow a predetermined amount or selectively variable amounts of outdoor air to enter conditioning unit 22. Preferably, air damper 36 is an economizer of any variety readily apparent to one skilled in the art. When air damper 36 is at least partially open, operation of the fan causes outdoor air to pass through air damper 36 and mix with the return air. The system of the invention preferably includes a temperature sensor 34 positioned outside conditioning unit 22 to sense the temperature of the outdoor air that enters the system through air damper 36. Again, a number of different temperature sensors can be used and selectively located to determine a temperature representative of the outside air temperature. For example, the sensor could be outside the conditioning unit or at the inlet of the outdoor duct.

As illustrated in FIG. 1, conditioning unit 22 includes a cooling stage 40, which in the illustration is positioned between fan 38 and supply air duct 24. Fan 38 moves air through the cooling stage to cool the supply air. Preferably, cooling stage 40 includes a series of compressors associated with one or more refrigerant loops that are individually controllable so that one or more of the compressors may be operated at a given time to control the amount of cooling provided to the supply air.

Conditioning unit 22 also includes a heating stage 46 positioned between fan 38 and supply air duct 24. Fan 38 moves air through the heating stage to heat the air entering the supply air duct. Heating stage 46 includes one or more heating elements 47 and 49, such as, for example, electric coils, hot water coils, gas-fired elements, heat pumps, or any other heating device known to one skilled in the art. Preferably, heating stage 46 includes a series of heating elements or other staged means to achieve two or more stages of heating. Each of the series of heating elements or stages is individually controllable, or the heating capacity of the heating stage 46 is otherwise varied, so that one or more of the heating elements may be operated at a given time to control the amount of heating provided to the supply air.

The invention includes a control system for controlling the operation of conditioning unit 22 in response to sensed parameters and a flow logic, such as software, within the control system. The control system includes one or more thermostats 30 preferably positioned within the zone(s) 28. The thermostat 30 may include a selection switch for selecting the operating mode of the conditioning unit. A user may set the switch to operate the conditioning unit in one of the heating, cooling, or ventilating modes. In the most preferred embodiment, the thermostat can operate in an automatic mode in which the cooling stage, heating stage, and air damper are automatically controlled (turned on, off, or varied), according to a selected desired temperature (or an acceptable range of desired temperatures), and other sensed parameters of the system.

The control system of the present invention preferably includes a computer, such as a microprocessor and a memory. The computer can be incorporated within the thermostat itself, or can be a separate unit that is part of the entire HVAC system. In the preferred embodiment, the computer control is a digital control system incorporated into the HVAC system and connectable with the thermostat (s) and working components of the HVAC system. For example, the computer and its associated components can be positioned near the heating and cooling stages and connected with the sensors and controls for the various components of the HVAC system.

The computer, or central control, is connected to the outdoor thermometer or temperature sensor 34 by line 31, the supply thermometer or temperature sensor 26 by line 33, the thermostat 30, and the components of conditioning unit 22 by line 35. The connection of the central control and the outdoor temperature sensor 34 allows the central control to read the temperature of the outdoor air. The connection of the central control and the supply temperature sensor 34 allows the central control to read the temperature of the supply air. The connection of the central control with the components of the conditioning unit (such as with the heating cooling, and air damper) allows the control to read the status of these components at any given time and to control their operation.

The central control, in response to the condition called for by the thermostat, regulates the temperature of the air in the enclosure. Preferably, the thermostat is a programmable thermostat that allows the user to select a desired temperature to be maintained within the enclosure. The thermostat also preferably either allows the user to select a temperature range for the air supplied to the enclosure when the conditioning unit is operating in the ventilation mode, or itself chooses an appropriate range based on sensed and/or preselected criteria. As explained in more detail below, the central control will operate conditioning unit 22 in the selected heating or cooling mode to maintain the temperature of the enclosure at the desired temperature. In addition, when the desired set temperature is achieved and the conditioning unit is operating in the ventilation mode, the central control will activate heating stage 46 or cooling stage 40 and/or modulate air damper 36 to ensure the temperature of the supply air is within the specified temperature range.

Figure 2:
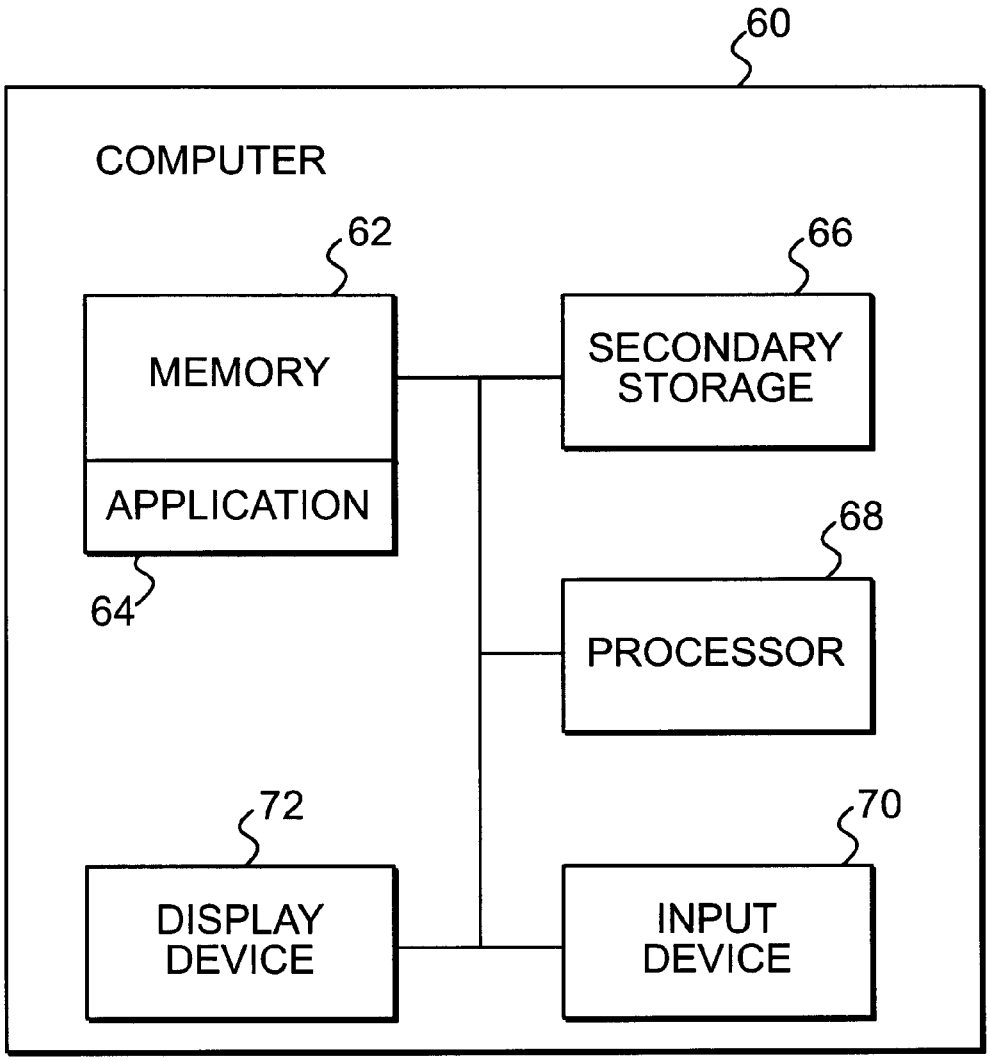
FIG. 2 is a schematic diagram of a device for controlling the operation of an air conditioning unit.

The central control preferably includes a computer, which may be a direct digital control (DDC) or other device readily apparent to one skilled in the art. FIG. 2 depicts in more detail computer 60 suitable for controlling the operation of conditioning unit 22. Preferably, computer 60 includes a memory 62, a secondary storage device 66, a processor 68 such as a central processing unit, an input device 70, and a display device 72. Memory 62 and secondary storage 66 may store applications, such as application 64, or information for execution and use by processor 68.

Although computer 60 is depicted with various components, one skilled in the art will appreciate that this computer can contain additional or different components. Furthermore, although aspects of the present invention are described as being stored in memory, one skilled in the art will appreciate that these aspects can also be stored on or read from other types of computer program products or computer-readable media, such as secondary storage devices, including hard disks, floppy disks, or CD-ROM, or other forms of RAM or ROM. These aspects of the present invention may also include modules, implemented in software, hardware, or a combination, configured to perform a particular method implementing an embodiment consistent with the present invention. In addition, the computer-readable media may include instructions for controlling a computer system, such as computer 60, to perform a particular method.

The operation of a preferred embodiment of the aforementioned system will now be described with reference to the attached drawings. Prior to activating the HVAC unit, the user must set the mode selection switch and desired temperature in the programmable thermostat. To set the programmable thermostat, the user selects a desired temperature to be maintained within the enclosure. In addition, the user selects a desired temperature range for the supply air, or the computer itself makes this selection. The desired temperature range for the supply air is defined by selecting an upper setpoint and a lower setpoint, which may be actually selected by the user or may be chosen by the computer based on the desired temperature to be maintained within the enclosure. In the application of the invention, one range of upper and lower setpoints may be used when the zone(s) are typically being cooled (e.g., summer operation) and a different range of upper and lower setpoints may be used when the zone(s) are typically being heated (e.g., winter operation).

In one embodiment of the invention, the user may also select the operating mode of the conditioning unit, either heating, cooling, or ventilating. In another embodiment, the user selects an automatic mode and the central control will then automatically operate the system in the heating, cooling, or ventilating mode, depending upon the set and sensed inputs to the central control. The operation of each of the three modes is discussed in greater detail below.

Cooling Operation

If the user, or the automatic control, selects the cooling mode and the temperature within enclosure 28 is greater than the desired temperature, the central control will activate fan 38 and one or more compressors of the cooling stage 40 and will move air damper 36 to the minimum position permitted by local ventilation codes, or otherwise selected. Fan 38 moves air through the cooling stage and into the enclosure to decrease the temperature of the zone(s). When the central control senses that the temperature of the zone(s) have dropped below the desired temperature, the cooling mode is satisfied and the central control will switch conditioning unit 22 to operate in the ventilation mode.

Figure 3:
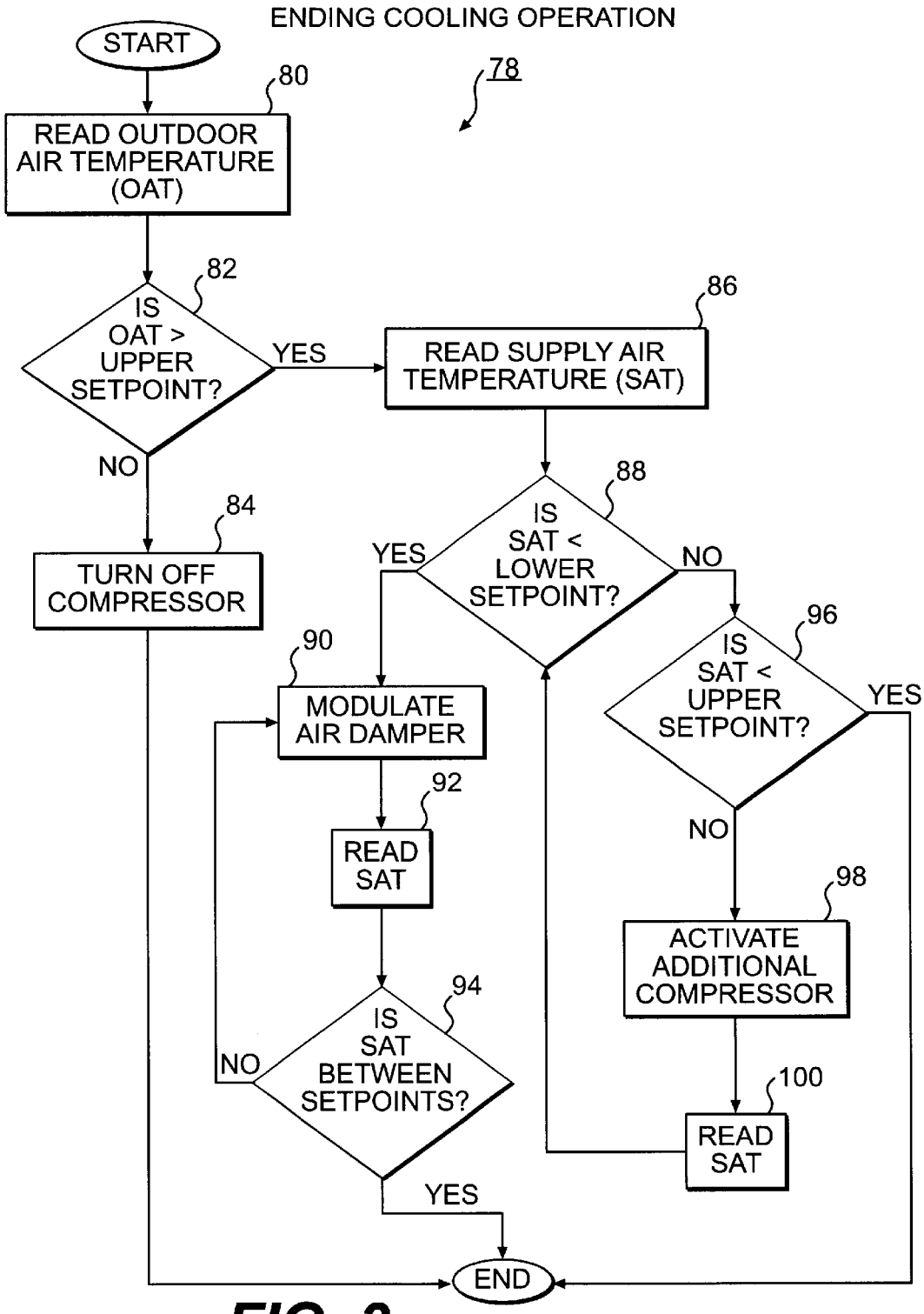
FIG. 3 is a flowchart illustrating a process for regulating the temperature of supply air after the cooling operation has ended.

Preferably, when ending the cooling operation, the central control continues to run fan 38, but turns off all but one of the compressors in the cooling stage 40. It is contemplated, however, that all of the compressors may be turned off when the cooling operation ends. The central control will then regulate the temperature of the supply air moved by fan 38 into enclosure 28. Generally, the central control will vary the position of the damper, or operate one or more cooling stages, to keep the supply air (the combination of return air and outdoor air) below an upper temperature, that is a preselected amount above the "desired" temperature for the conditioned zone(s). FIG. 3 is a flow chart of an exemplary process 78 for regulating the temperature of the supply air after the cooling operation has ended. Process 78 may be implemented by application 64 stored in memory 62 and controlling operation of processor 68.

Once the temperature in the zone(s) is cooled to the desired temperature selected on the thermostat(s), the central control will then apply the method and system of the preferred invention applicable to the ending of a cooling operation. In one preferred embodiment, the central control will first read the temperature of the outdoor air (step 80) provided by the outdoor temperature sensor 34. If the outdoor air temperature is less than the upper setpoint (step 82), the central control will turn off any active compressor in the cooling stage 40 (step 84). Because the temperature of the outdoor air is less than the upper setpoint, the addition of the outdoor air to the air returned from enclosure 28 will not raise the temperature of the supply air above the upper setpoint. Periodically, the central control will read the outdoor air temperature (step 80) and determine if the outdoor air temperature has risen above the upper setpoint.

If the outdoor air temperature is greater than the upper setpoint (step 82), the central control will read the temperature of the supply air (step 86) from the supply duct temperature sensor 26. If the supply air temperature is less than the lower setpoint (step 88), the central control will modulate air damper 36 to a more open state (step 90) to increase the amount of outdoor air mixing with the return air to thereby increase the temperature of the supply air.

After a predetermined delay (e.g., a delay of approximately five minutes), the central control will read the temperature of the supply air (step 92). If the volume of outdoor air added to the return air does not raise the temperature of the supply air above the lower setpoint, the central control opens air damper 36 further to increase the amount of outdoor air entering the system. If, however, the volume of outdoor air added to the return air raises the temperature of the supply air above the upper setpoint, the central control closes air damper 36 to decrease the amount of outdoor air entering the system, thereby lowering the temperature of the supply air. This modulation process (steps 90, 92, and 94) is repeated until the temperature of the supply air settles between the setpoints.

If the outdoor air temperature is greater than the upper setpoint and the supply air temperature is greater than the lower setpoint and the damper is at its most closed position possible under local code or preselected criteria, the central control will determine if the supply air temperature is greater than the upper setpoint (step 96). If the supply air temperature is greater than the upper setpoint, the central control will activate one compressor, or an additional compressor, in the cooling stage 40 (step 98) to increase the amount of cooling provided to the supply air. After a predetermined delay, e.g., a delay of approximately five minutes, the central control will read the supply air temperature (step 100).

If the additional compressor drops the supply air temperature below the lower setpoint, the central control will modulate air damper (steps 90, 92, and 94), as described above, to regulate the temperature of the supply air until the temperature settles between the setpoints. If the additional compressor does not drop the supply air temperature below the upper setpoint, the central control may start additional compressors (step 98) until the supply air temperature drops below the upper setpoint.

At the end of process 78, the temperature of the supply air will be between the setpoints. If the conditioning unit 22 remains in the ventilating mode for a period of time, the central control will repeat process 78 to ensure that the temperature of the supply air remains between the upper and lower setpoints. Once the thermostat(s) in the zone(s) indicate that the temperature in the zones have exceeded the selected temperature, the system will go back to the cooling mode.

Heating Operation

If the user, or the automatic control, selects the heating mode and the temperature within zone(s) 28 is less than the desired temperature, the central control will activate fan 38 and one or more of the heating stages 46 and move air damper 36 to the minimum position. Fan 38 moves air through the heating stages and into enclosure 28 to increase the temperature of the enclosure. When the central control senses that the temperature of the enclosure has risen above the desired temperature, the heating mode is satisfied and the central control will switch conditioning unit 22 to operate in the ventilation mode.

Figure 4A:
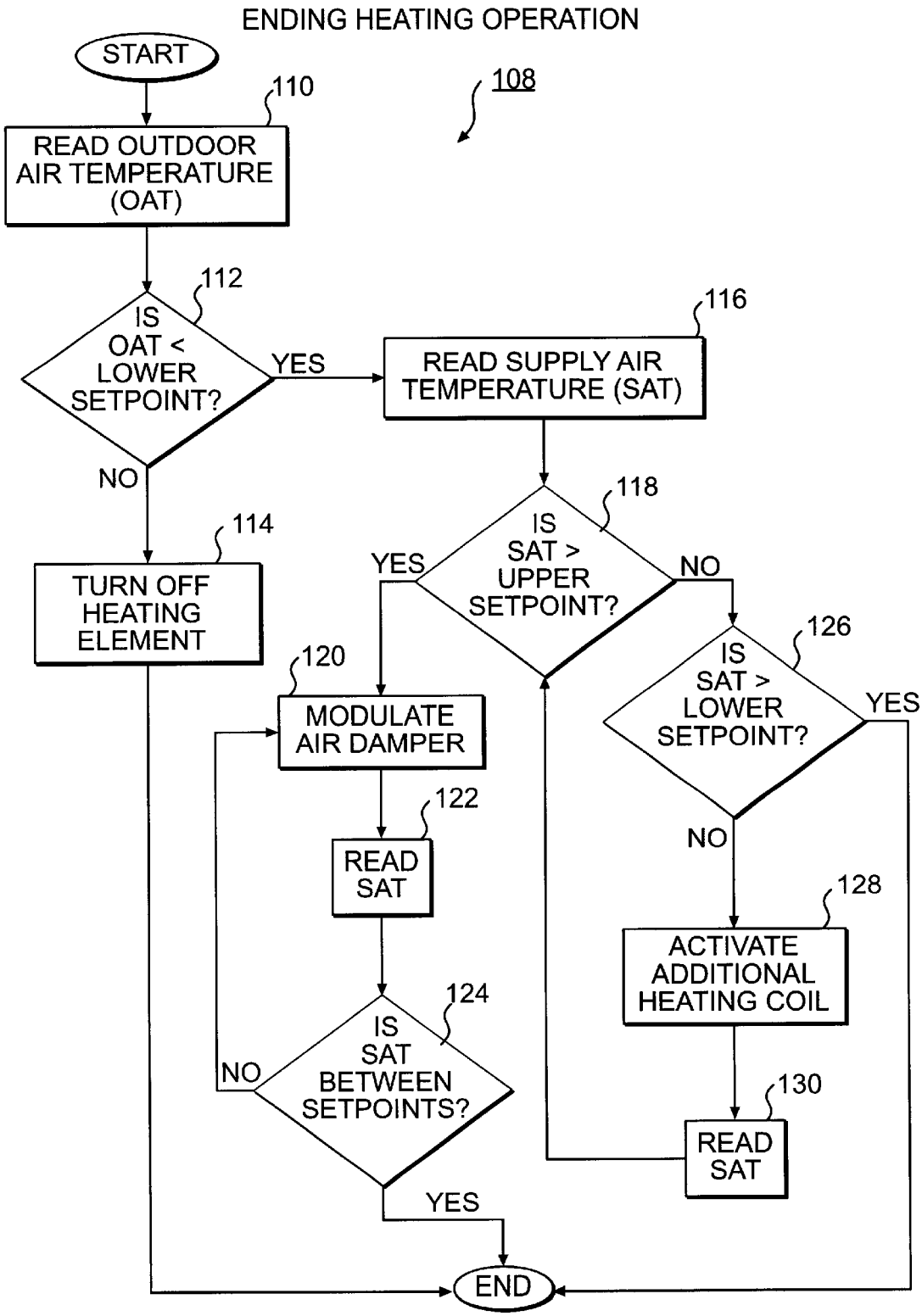
FIG. 4*a* is a flowchart illustrating a process for regulating the temperature of supply air after the heating operation has ended.

Preferably, when ending the heating operation, the central control continues to run fan 38, but turns off all but one of the heating elements in heating stage 46. It is contemplated, however, that all of the heating elements may be turned off when the heating operation ends. The central control will then regulate the temperature of the supply air moved by fan 38 into enclosure 28. Generally, the central control will vary the position of the damper, or operate one of more heating stages, to keep the supply air above a lower temperature limit, that is a predetermined amount below the "desired" temperature for the conditioned enclosure. FIG. 4*a* is a flow chart of an exemplary process 108 for regulating the temperature of the supply air after the heating operation has ended. Process 108 may be implemented by application 64 stored in memory 62 and controlling operation of processor 68.

The central control will first read the temperature of the outdoor air (step 110) provided by the outdoor temperature sensor 34. If the outdoor air temperature is greater than the lower setpoint (step 112), the central control will turn off any active heating elements in heating stage 46 (step 114). Because the temperature of the outdoor air is greater than the lower setpoint, the addition of the outdoor air to the air returned from enclosure 28 will not lower the temperature of the supply air below the lower setpoint. Periodically, the central control will read the outdoor air temperature (step 110). The central control will then determine if the outdoor air temperature has dropped below the lower setpoint.

If the outdoor air temperature is less than the lower setpoint (step 112), the central control will read the temperature of the supply air (step 116) from the supply duct temperature sensor 26. If the supply air temperature is greater than the upper setpoint (step 118), the central control will modulate air damper 36 (step 120) to increase the volume of outdoor air mixing with the return air. Increasing the volume of outdoor air added to the return air will decrease the temperature of the supply air.

After a predetermined delay, e.g., a delay of approximately five minutes, the central control will read the temperature of the supply air (step 122). If the volume of outdoor air added to the return air does not drop the temperature of the supply air below the upper setpoint, the central control modulates air damper 36 further to increase the amount of outdoor air entering the system. If, however, the volume of outdoor air added to the return air drops the temperature of the supply air below the lower setpoint, the central control closes air damper 36 to decrease the amount of outdoor air entering the system, thereby lowering the temperature of the supply air. This modulation process (steps 120, 122, and 124) is repeated until the temperature of the supply air settles between the setpoints.

If the outdoor air temperature is less than the lower setpoint, the supply air temperature is less than the upper setpoint, and the damper is at its most closed position possible under local code or preselected criteria, the central control will determine if the supply air temperature is less than the lower setpoint (step 126). If the supply air temperature is less that the lower setpoint, the central control will activate one, or an additional heating element, in heating stage of heating 46 (step 128) or will otherwise increase the heating capacity of the heating stage. After a predetermined delay, e.g., a delay of approximately five minutes, the central control will read the supply air temperature (step 130).

If the additional heating element raises the supply air temperature above the higher setpoint, the central control will modulate air damper 36 (steps 120, 122 and 124), as described above, to regulate the temperature of the supply air to between the setpoints. If the additional heating element does not raise the supply air temperature to the lower setpoint, the central control may start additional heating elements stages (step 98) until the supply air temperature rises above the lower setpoint.

At the end of process 108, the temperature of the supply air will be between the setpoints. If the conditioning unit 22 remains in the ventilating mode for a period of time, the central control will repeat process 108 to ensure that the temperature of the supply air remains between the upper and lower setpoints.

Figure 4B:
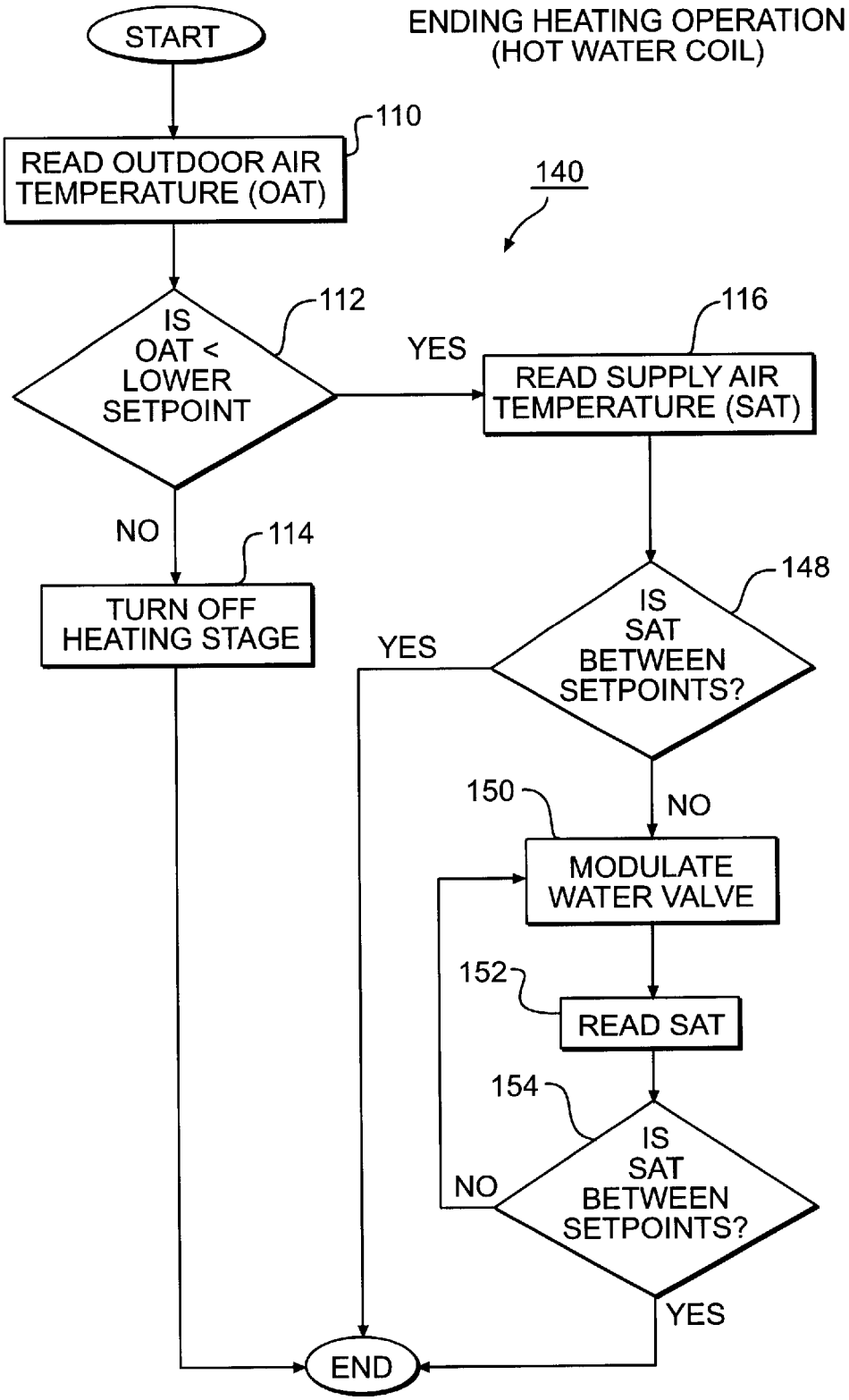
FIG. 4*b* is a flowchart illustrating a process for regulating the temperature of supply air when a heating operation for a hot water coil heater has ended.

A second process 140 is illustrated in the flowchart of FIG. 4*b* for an embodiment of the conditioning unit 22 that incorporates a hot-water coil as the heating stage. The initial steps (steps 110, 112, 114, and 116) of second process 140 are the same as the initial steps of process 108 described above. However, if the outdoor air temperature is less than the lower setpoint (step 112) and the supply air temperature is outside the setpoints (step 148), the central control will modulate the hot water valve of the hot water coil (step 150). If the supply air temperature is above the upper setpoint, the amount of hot water flowing through the coil is reduced to decrease the amount of heating provided to the supply air. If the supply air temperature is below the lower setpoint, the amount of hot water flowing through the coil is increased to increase the amount of heating provided to the supply air. After a delay of approximately five minutes, the central control reads the supply air temperature (step 152). If the supply air temperature remains outside the setpoints (step 154) the step of modulating the water valve (step 150) is repeated until the supply air temperature settles between the setpoints.

At the end of process 140, the temperature of the supply air will be between the setpoints. If the conditioning unit 22 remains in the ventilating mode for a period of time, the central control will repeat process 140 to ensure that the temperature of the supply air remains between the upper and lower setpoints.

Ventilating Mode

Figure 5A:
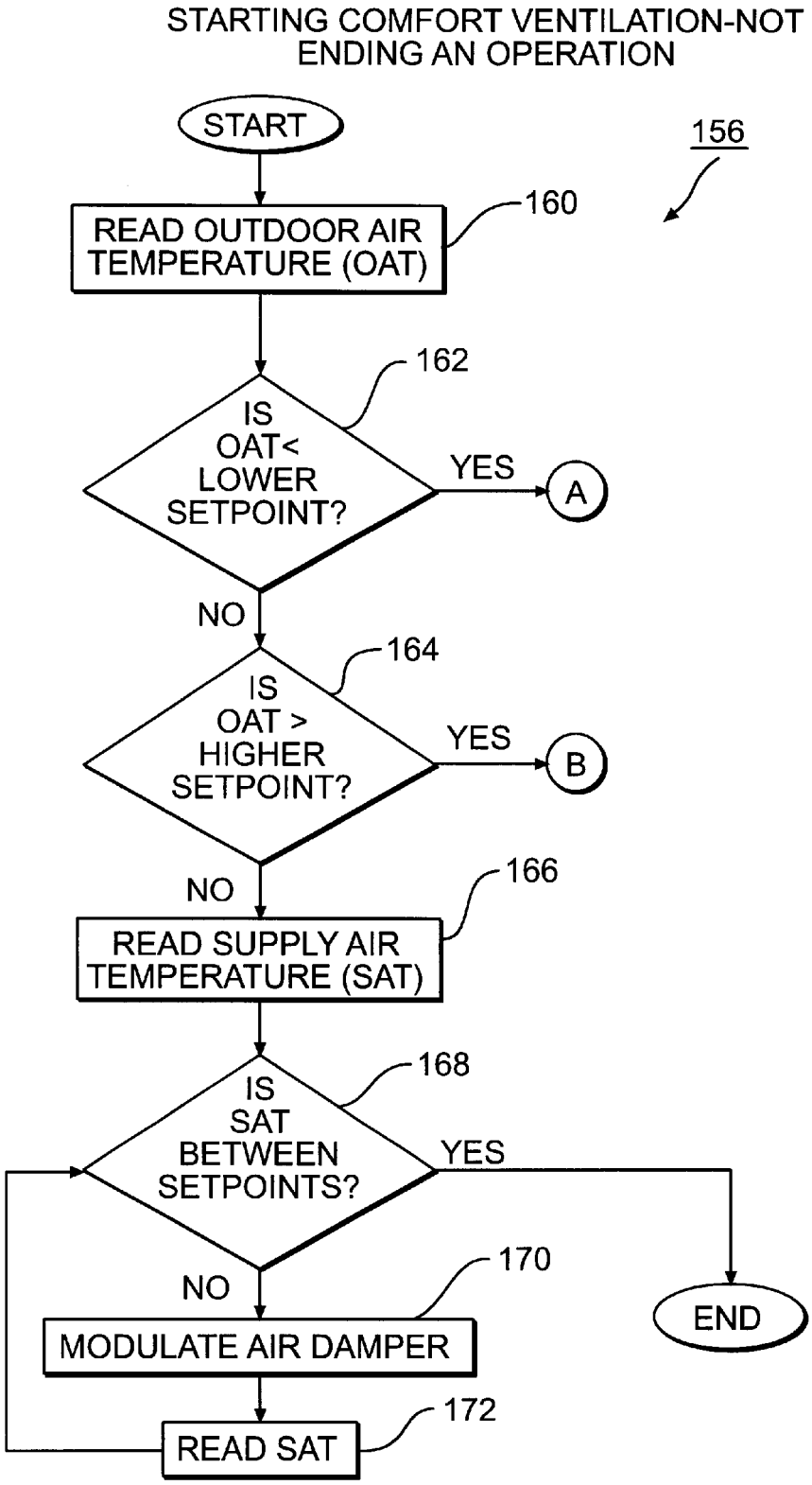
FIGS. 5*a–c* are flowcharts illustrating a process for regulating the temperature of supply air when the conditioning unit is activated in the ventilating mode.
Figure 5B:
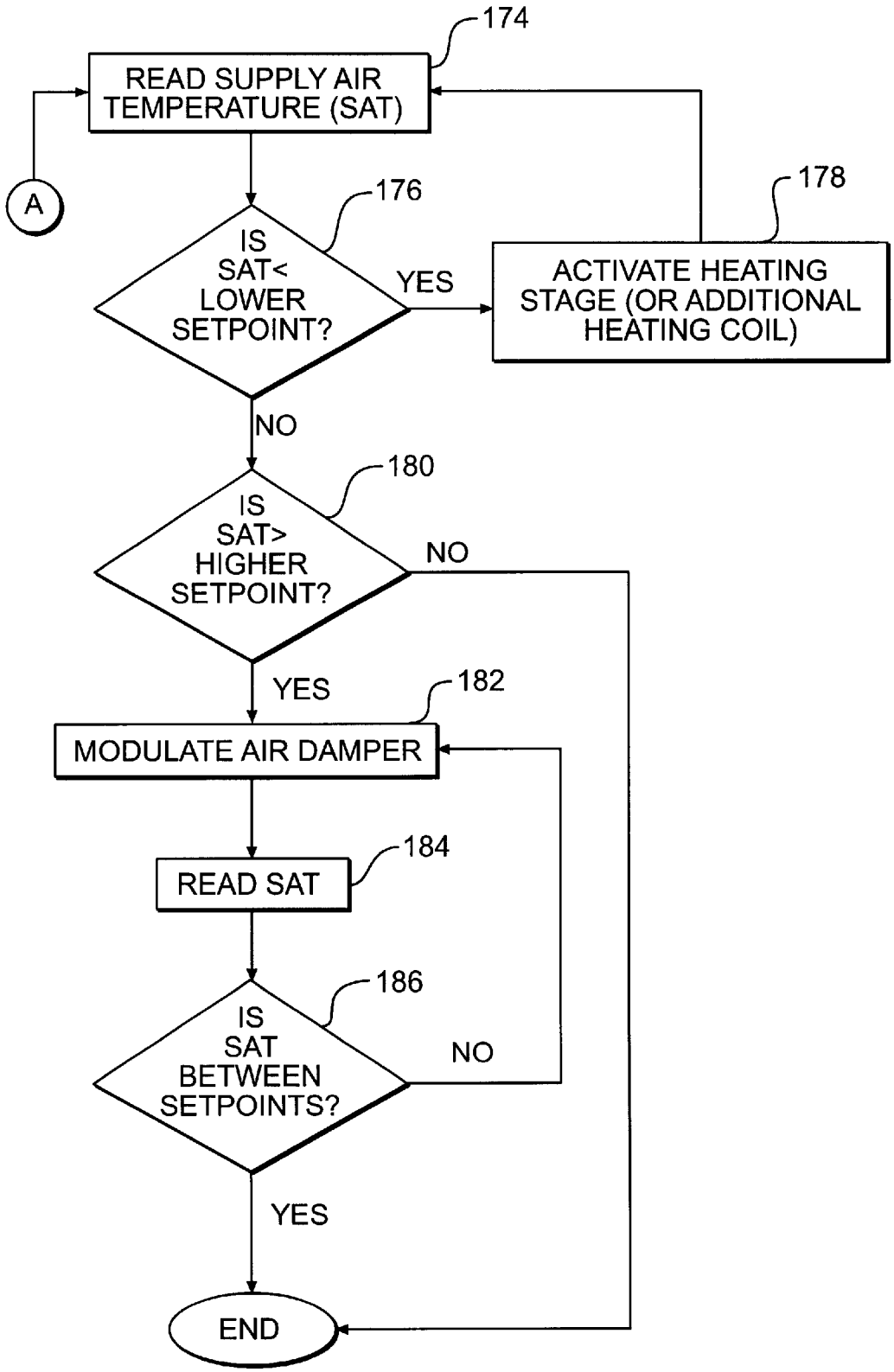
Figure 5C:
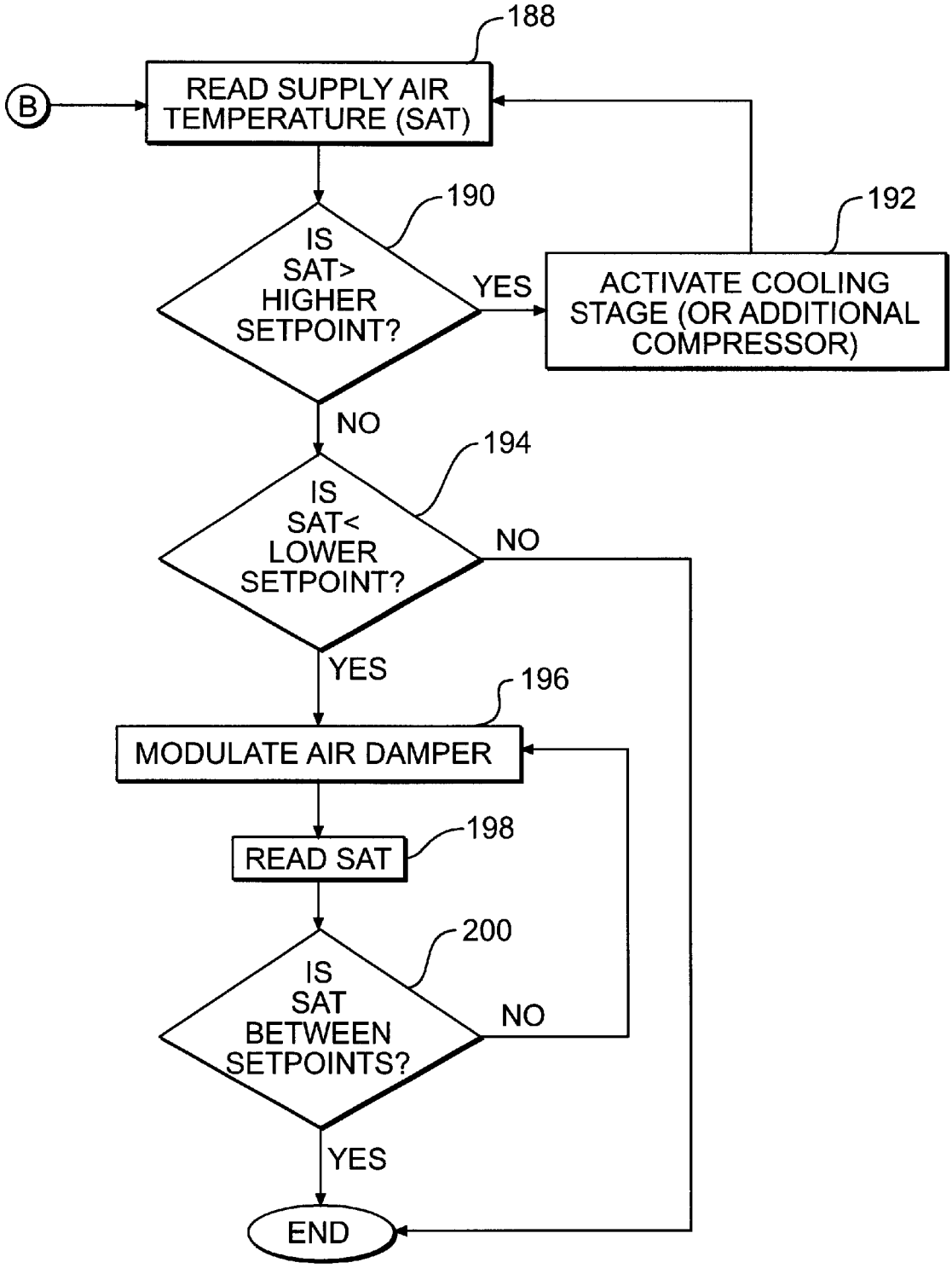

If the user, or the automatic control, selects the ventilating mode only, the central control will operate only the fan 38 of the conditioning unit 22 and will activate cooling stage 40 and heating stage 46 only to regulate the supply air temperature within the selected range. In this mode, the zone will be slightly heated or cooled by supply air that falls within the predetermined highest and lowest temperature setpoints. This mode will provide fresh air to the zone(s), the supplied air will be comfortable to the occupants, and limited energy will be expended. FIGS. 5*a*–5*c* are flow charts of an exemplary process 156 for regulating the temperature of the supply air when the conditioning unit is activated in the ventilating mode. Process 156 may be implemented by application 64 stored in memory 62 and controlling operation of processor 68.

In the ventilation mode, the central control operates fan 38 to provide supply air to the enclosure. The central control reads the outdoor air temperature (step 160). If the outdoor air temperature is less than the lower setpoint (step 162), the central control will then read the supply air temperature (step 174). If the supply air temperature is less than the lower setpoint (step 176), the central control will activate a heating coil in heating stage 46 (step 178). After a delay of approximately five minutes, the central control will read the supply air temperature. If the temperature is still less than the lower setpoint, the central control will activate another heating element in heating stage 46. Additional heating elements are successively activated until the supply air temperature rises above the lower setpoint.

If adding the additional heating elements causes the supply air temperature to exceed the higher setpoint (step 180), the central control modulates air damper 36 to introduce a larger volume of the cooler outdoor air into the system (step 182). After a delay of approximately five minutes, the central control reads the supply air temperature (step 184). If the supply air temperature is still greater than the upper setpoint, the central control modulates air damper 36 to allow more of the cooler outdoor air into the system. If the supply air temperature is less than the lower setpoint, the central control modulates air damper 36 to decrease the amount of the cooler air entering the system. This modulation process (steps 182, 184, and 186) is repeated until the supply air temperature settles between the setpoints.

If the outdoor air temperature is greater than the higher setpoint (step 164), the central control will then read the supply air temperature (step 188). If the supply air temperature is greater than the higher setpoint (step 190), the central control will activate a compressor in cooling stage 40 (step 192). After a delay of approximately five minutes, the central control will again read the supply air temperature. If the supply air temperature is still greater than the higher setpoint, the central control will activate another compressor in cooling stage 40. Additional compressors are successively activated until the supply air temperature cools to below the higher setpoint.

If adding the additional compressors causes the supply air temperature to cool below the lower setpoint (step 194), the central control modulates air damper 36 to introduce a larger volume of the warmer outdoor air into the system (step 196). After a delay of approximately five minutes, the central control reads the supply air temperature (step 198). If the supply air temperature is still less than the lower setpoint, the central control modulates air damper 36 to allow more of the warmer outdoor air into the system. If the supply air temperature is greater than the upper setpoint, the central control modulates air damper 36 to decrease the amount of the warmer air entering the system. This modulation process (steps 196, 198, and 200) is repeated until the supply air temperature settles between the setpoints.

If the outdoor air is between the setpoints (steps 162 and 64), the central control will read the supply air temperature 166. If the supply air temperature is either greater than the upper setpoint or less than the lower setpoint, the central control modulates air damper 36 to allow more of the outdoor air into the system. This modulation process (steps 168, 170, and 172) is repeated until the supply air temperature settles between the setpoints.

At the end of process 156, the temperature of the supply air will be between the setpoints. If the conditioning unit 22 remains in the ventilating mode for a period of time, the central control will repeat process 156 to ensure that the temperature of the supply air remains between the upper and lower setpoints.

It will be apparent to those skilled in the art that various modifications and variations can be made in the method and system for conditioning air in an enclosure without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A system for conditioning air within one or more zones, comprising:

a conditioning unit having a heating stage, a cooling stage, and a fan, the fan selectively operable to move air through at least one of the heating and cooling stages and to provide supply air to the one or more zones;

an economizer operable to selectively supply variable amounts of outdoor air to the conditioning unit;

a supply temperature sensor exposed to the supply air to sense the temperature of the supply air;

an indoor temperature sensor exposed to the air in at least one of the one or more zones to sense the temperature of the air within the one or more zones; and a central control coupled with said sensors, conditioning unit, and economizer, the control selectively operating at least one of the heating stage, the cooling stage, and the economizer when the sensed temperature of the air in the one or more zones is outside of a first predetermined temperature range and further selectively operating at least one of the heating stage, the cooling stage, and the economizer when the sensed temperature of the air in the one or more zones is within the first predetermined temperature range and the sensed temperature of the supply air is outside of a second predetermined temperature range.

2. The system of claim 1, further comprising an outdoor temperature sensor exposed to the outdoor air to sense the temperature of the outdoor air, and wherein the central control controls at least one of the economizer, heating stage, and cooling stage based on the sensed outdoor and supply air temperatures.

3. The system of claim 2, wherein the central control modulates the economizer to adjust the volume of outdoor air entering the conditioning unit based on the temperature of the supply air and the temperature of the outdoor air.

4. The system of claim 1, further comprising a return air duct for conducting return air from the enclosure to the conditioning unit.

5. The system of claim 1, wherein the conditioning unit is a constant-volume roof-top heating, ventilating and air conditioning unit.

6. The system of claim 1, wherein the conditioning unit includes a plurality of heating stages.

7. The system of claim 1, wherein the conditioning unit includes a plurality of cooling stages.

8. The system of claim 1, wherein the heating stage includes a hot water coil having a control valve.

9. The system of claim 1, further comprising a thermostat coupled to the main control and operable to set the first predetermined temperature range to be maintained within the one or more zones.

10. The system of claim 1, wherein the second predetermined temperature range includes an upper setpoint and a lower setpoint.

11. The system of claim 10, wherein the conditioning unit includes a plurality of heating stages and the central control activates at least one of the heating stages when the sensed temperature of the air in the one or more zones is within the first predetermined temperature range and the sensed temperature of the supply air is below the lower setpoint.

12. The system of claim 10, further comprising an outdoor temperature sensor exposed to the outdoor air to sense the temperature of the outdoor air, the central control modulating the economizer to increase the amount of outdoor air supplied to the conditioning unit when the sensed temperature of the air in the one or more zones is within the first predetermined temperature range, the sensed temperature of the supply air is above the upper setpoint, and the temperature of the outdoor air is below the lower setpoint.

13. The system of claim 12, wherein the central control modulates the economizer to increase the amount of outdoor air supplied to the conditioning unit until the temperature of the supply air is between the upper and lower setpoints.

14. The system of claim 10, wherein the conditioning unit includes a plurality of cooling stages and the central control activates at least one of the cooling stages when the sensed temperature of the air in the one or more zones is within the first predetermined temperature range and the sensed temperature of the supply air is above the lower setpoint.

15. The system of claim 10, further comprising an outdoor temperature sensor exposed to the outdoor air to sense the temperature of the outdoor air, the central control modulating the economizer to increase the amount of outdoor air supplied to the conditioning unit when the sensed temperature of the air in the one or more zones is within the first predetermined temperature range, the sensed temperature of the supply air is below the lower setpoint, and the temperature of the outdoor air is above the upper setpoint.

16. The system of claim 15, wherein the central control modulates the economizer to increase the amount of outdoor air supplied to the conditioning unit until the temperature of the supply air is between the upper and lower setpoints.

17. A system for conditioning air within one or more zones, comprising:

a conditioning unit having a heating stage and a fan, the fan selectively operable to move air through the heating stage to provide supply air to the one or more zones;

an economizer operable to selectively supply variable amounts of outdoor air to the conditioning unit;

a supply temperature sensor exposed to the supply air to sense the temperature of the supply air;

an indoor temperature sensor exposed to the air in at least one of the one or more zones to sense the temperature of the air within the one or more zones; and a central control coupled with said sensors, conditioning unit, and economizer, the control selectively operating at least one of the heating stage and the economizer when the sensed temperature of the air in the one or more zones is outside a first predetermined temperature range and further selectively operating at least one of the heating stage and the economizer when the sensed temperature of the air in the one or more zones is within the first predetermined temperature range and the sensed temperature of the supply air is outside of a second predetermined temperature range.

18. The system of claim 17, further comprising a thermostat coupled to the main control and operable to set the first predetermined temperature range to be maintained within the one or more zones.

19. The system of claim 17, wherein the second predetermined temperature range includes an upper setpoint and a lower setpoint.

20. The system of claim 19, wherein the conditioning unit includes a plurality of heating stages and the central control activates at least one of the heating stages when the sensed temperature of the air in the one or more zones is within the first predetermined temperature range and the sensed temperature of the supply air is below the lower setpoint.

21. The system of claim 19, further comprising an outdoor temperature sensor exposed to the outdoor air to sense the temperature of the outdoor air, the central control modulating the economizer to increase the amount of outdoor air supplied to the conditioning unit when the sensed temperature of the air in the one or more zones is within the first predetermined temperature range, the sensed temperature of the supply air is above the upper setpoint, and the temperature of the outdoor air is below the lower setpoint.

22. The system of claim 21, wherein the central control modulates the economizer to increase the amount of outdoor air supplied to the conditioning unit until the temperature of the supply air is between the upper and lower setpoints.

23. The system of claim 19, wherein the heating stage includes a hot water coil.

24. A system for conditioning air within one or more zones, comprising:

a conditioning unit having a cooling stage and a fan, the fan selectively operable to move air through the cooling stage to provide supply air to the one or more zones;

an economizer operable to selectively supply variable amounts of outdoor air to the conditioning unit;

a supply temperature sensor exposed to the supply air to sense the temperature of the supply air;

an indoor temperature sensor exposed to the air in at least one of the one or more zones to sense the temperature of the air within the one or more zones; and a central control coupled with said sensors, conditioning unit, and economizer, the control selectively operating at least one of the cooling stage and the economizer when the sensed temperature of the air in the one or more zones is outside a first predetermined temperature range and further selectively operating at least one of the cooling stage and the economizer when the sensed temperature of the air in the one or more zones is within the first predetermined temperature range and the sensed temperature of the supply air is outside of a second predetermined temperature range.

25. The system of claim 24, further comprising a thermostat coupled to the main control and operable to set the first predetermined temperature range to be maintained within the one or more zones.

26. The system of claim 24, wherein the second predetermined temperature range includes an upper setpoint and a lower setpoint.

27. The system of claim 26, wherein the conditioning unit includes a plurality of cooling stages and the central control activates at least one of the cooling stages when the sensed temperature of the air in the one or more zones is within the first predetermined temperature range and the sensed temperature of the supply air is above the lower setpoint.

28. The system of claim 26, further comprising an outdoor temperature sensor exposed to the outdoor air to sense the temperature of the outdoor air, the central control modulating the economizer to increase the amount of outdoor air supplied to the conditioning unit when the sensed temperature of the air in the one or more zones is within the first predetermined temperature range, the sensed temperature of the supply air is below the lower setpoint, and the temperature of the outdoor air is above the upper setpoint.

29. The system of claim 28, wherein the central control modulates the economizer to crease the amount of outdoor air supplied to the conditioning unit until the temperature of the supply air is between the upper and lower setpoints.

* * * * *

UNITED STATES PATENT AND TRADEMARK OFFICE

CERTIFICATE OF CORRECTION

PATENT NO. : 6,250,382 B1
DATED : June 26, 2001
INVENTOR(S) : Rayburn et al.

It is certified that error appears in the above-identified patent and that said Letters Patent is hereby corrected as shown below:

Column 14,
Line 50, “to crease” should read -- to increase --.

Signed and Sealed this

Eighth Day of July, 2003

JAMES E. ROGAN
*Director of the United States Patent and Trademark Office*